US010655297B2

(12) United States Patent
Stener et al.

(10) Patent No.: US 10,655,297 B2
(45) Date of Patent: May 19, 2020

(54) HYDRAULIC SYSTEM AND A METHOD FOR MOVING AN IMPLEMENT OF A WORKING MACHINE

(71) Applicant: VOLVO CONSTRUCTION EQUIPMENT AB, Eskilstuna (SE)

(72) Inventors: Patrik Stener, Torshälla (SE); Johan Lillemets, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 153 days.

(21) Appl. No.: 15/750,851

(22) PCT Filed: Aug. 19, 2015

(86) PCT No.: PCT/SE2015/050881
§ 371 (c)(1),
(2) Date: Feb. 7, 2018

(87) PCT Pub. No.: WO2017/030476
PCT Pub. Date: Feb. 23, 2017

(65) Prior Publication Data

US 2018/0230669 A1 Aug. 16, 2018

(51) Int. Cl.
*E02F 3/42* (2006.01)
*E02F 9/20* (2006.01)
(Continued)

(52) U.S. Cl.
CPC ..... *E02F 3/422* (2013.01); *E02F 9/2095* (2013.01); *E02F 9/2207* (2013.01);
(Continued)

(58) Field of Classification Search
CPC ..... E02F 3/422; E02F 9/2207; E02F 9/2217; E02F 9/2239; E02F 9/2289; E02F 9/2292; F15B 11/17
See application file for complete search history.

(56) References Cited

U.S. PATENT DOCUMENTS 3,971,215 A 7/1976 Baron et al.
4,531,369 A 7/1985 Izumi et al.
(Continued)

FOREIGN PATENT DOCUMENTS

WO 9916981 A1 4/1999
WO 2012138264 A1 10/2012

OTHER PUBLICATIONS

International Search Report (dated May 10, 2016) for corresponding International App. PCT/SE2015/050881.

*Primary Examiner* — Michael Leslie
*Assistant Examiner* — Daniel S Collins
(74) *Attorney, Agent, or Firm* — Sage Patent Group

(57) ABSTRACT

A hydraulic system for moving an implement of a working machine includes a hydraulic cylinder with a cylinder and a piston which is adapted to move in the cylinder to thereby move the implement relative to a body structure of the working machine, and an actuator pump arranged to provide hydraulic fluid to the hydraulic cylinder, the hydraulic cylinder having a first port and a second port adapted to be in fluid communication with the actuator pump, the hydraulic cylinder and the actuator pump being arranged so that the hydraulic cylinder is directly controlled by the actuator pump so that the rate of movement of the piston of the hydraulic cylinder is purely pump controlled, the hydraulic system further including a hydraulic accumulator for suspension of the implement, which hydraulic accumulator is arranged to be selectively connectable to the first port, the hydraulic system further including a further pump in addition to the actuator pump, the hydraulic accumulator being arranged to be pressurised by the further pump.

24 Claims, 6 Drawing Sheets

(51) Int. Cl.

| | |
|---|---|
| ***F15B 11/17*** | (2006.01) |
| ***F15B 1/02*** | (2006.01) |
| ***E02F 9/22*** | (2006.01) |
| *E02F 3/28* | (2006.01) |

(52) U.S. Cl.
CPC ..... *E02F 9/2217* (2013.01); *E02F 9/2239* (2013.01); *E02F 9/2271* (2013.01); *E02F 9/2289* (2013.01); *E02F 9/2292* (2013.01); *F15B 1/024* (2013.01); *F15B 11/17* (2013.01); *E02F 3/283* (2013.01); *E02F 9/2267* (2013.01); *F15B 2211/20515* (2013.01); *F15B 2211/20561* (2013.01); *F15B 2211/212* (2013.01); *F15B 2211/30* (2013.01)

(56) References Cited

U.S. PATENT DOCUMENTS

| | | | | |
|---|---|---|---|---|
| 5,706,657 | A | 1/1998 | Amborski et al. | |
| 6,666,022 | B1 * | 12/2003 | Yoshimatsu ..... | B60K 6/46 60/413 |
| 2003/0015847 | A1 | 1/2003 | Chatterjea | |
| 2013/0125536 | A1 * | 5/2013 | Ho ..... | F15B 1/024 60/327 |
| 2015/0059325 | A1 * | 3/2015 | Knussman ..... | E02F 9/2217 60/327 |
| 2016/0032946 | A1 | 2/2016 | Cho et al. | |

* cited by examiner

HYDRAULIC SYSTEM AND A METHOD FOR MOVING AN IMPLEMENT OF A WORKING MACHINE

BACKGROUND AND SUMMARY

The invention relates to a hydraulic system for moving an implement of a working machine, a working machine, in particular a wheel loader, comprising a hydraulic system, a method for moving an implement of a working machine, a computer program, a computer readable medium, and a controller for a hydraulic system.

A working machine, such as a wheel loader, is usually provided with a bucket, container, gripper or other type of implement for digging, carrying and/or transporting a load. For example, a wheel loader has a lift arm unit for raising and lowering the implement. Usually a pair of hydraulic cylinders is arranged for raising the load arm and a further hydraulic cylinder is arranged for tilting the implement relative to the load arm.

In addition, the working machine is often articulated frame-steered and has a pair of hydraulic cylinders for turning/steering the working machine by pivoting a front section and a rear section of the working machine relative to each other.

The hydraulic system generally further comprises at least one hydraulic pump, which is arranged to supply hydraulic power, i.e. hydraulic flow and/or hydraulic pressure, to the hydraulic cylinders. In traditional wheel loaders, the hydraulic pump is driven by the internal combustion engine of the working machine. In additional, the hydraulic system of a working machine is usually a so-called load sensing system (LS-system). This means that the pump receives a signal representing the current load pressure of a hydraulic cylinder in operation. The pump is thereby controlled to provide a pressure which is somewhat higher than the load pressure of the cylinder.

With increasing demands for more energy efficient working machines, traditional systems for powering the hydraulic cylinders present certain problems. For example, LS-systems require a pressure drop for the hydraulic cylinder control, and this requires the pump to provide more energy than what is required for the hydraulic cylinders to perform their respective tasks. Thus, there is a desire to provide a more energy efficient solution for working machine hydraulic systems.

It is desirable to reduce energy consumption for moving implements of working machines.

According to an aspect of the present invention, a hydraulic system for moving an implement of a working machine is provided, the hydraulic system comprising a hydraulic cylinder with a cylinder and a piston which is adapted to move in the cylinder to thereby move the implement relative to a body structure of the working machine, and an actuator pump arranged to provide hydraulic fluid to the hydraulic cylinder, the hydraulic cylinder having a first port and a second port adapted to be in fluid communication with the actuator pump, the hydraulic cylinder and the actuator pump being arranged so that the hydraulic cylinder is directly controlled by the actuator pump so that the rate of movement of the piston of the hydraulic cylinder is purely pump controlled, the hydraulic system further comprising a hydraulic accumulator for suspension of the implement, which hydraulic accumulator is arranged to be selectively connectable to the first port, the hydraulic system further comprising a further pump in addition to the actuator pump, the hydraulic accumulator being arranged to be pressurised by the further pump.

It is understood that the actuator pump and the further pump are hydraulic pumps. It is further understood that the movement of the hydraulic cylinder piston provides for the hydraulic cylinder to change length to thereby move the implement relative to a body structure of the working machine.

The hydraulic cylinder may be a lifting hydraulic cylinder adapted to raise and lower the implement relative to the body structure of the working machine. For example, the implement may be arranged on an elongated load arm, also referred to as a boom, for lifting and lowering the implement relative to the body structure. The elongated load arm may be at a first end pivotally connected to the body structure, and the implement may be mounted to the load arm at a second end of the load arm. The lifting hydraulic cylinder may extend between the body structure and the load arm. Thus, the lifting hydraulic cylinder may provide for lifting the implement by a pivoting movement of the load arm around its first end.

The hydraulic cylinder may alternatively be a tilting hydraulic cylinder adapted to tilt the implement relative to the body structure of the working machine. For example, the implement may be pivotally mounted to the load arm at the second end of the load arm, and the tilting hydraulic cylinder may extend from the load arm or the body structure to a linkage mechanism, which is adapted to transfer movements from the tilting hydraulic cylinder to the implement to tilt the implement.

The hydraulic cylinder and the actuator pump being arranged so that the hydraulic cylinder is directly controlled by the actuator pump so that the rate of movement of the piston of the hydraulic cylinder is purely pump controlled, means that the hydraulic cylinder is flow controlled. This means that the rate of movement of the piston is directly proportional to the fluid flow generated by, and therefore passing through the actuator pump. Thus, the hydraulic cylinder and the actuator pump may be connectable directly to each other. Thereby, the rate of movement of the piston of the hydraulic cylinder may be controlled solely by the actuator pump, or solely by the actuator pump and a boost pump as exemplified below. There may be a linear relationship between the rate of movement of the piston of the hydraulic cylinder and the fluid flow generated by the actuator pump.

Controlling the rate of movement of the piston of the hydraulic cylinder is herein understood as not including changing the direction of movement of the piston within the hydraulic cylinder. However, as exemplified herein, the actuator pump may nevertheless be arranged so as to provide a change of the piston movement direction, e.g. in the case of a rotational pump, by changing the pump rotation direction. Nevertheless, such a movement direction change may also be provided by a suitable valve arrangement. In any case, the rate of movement of the piston is purely pump controlled. Thus, the hydraulic cylinder control does not include controlling the rate of movement of the piston with a valve. I.e. the change of the piston velocity from one velocity in one of the two directions in the cylinder, to another velocity in the same direction in the cylinder, is purely pump controlled.

It is understood that the hydraulic cylinder will normally be influenced by the force of gravity, and a pure pump control may include power being provided to the hydraulic cylinder from the actuator pump, or power being delivered to from the hydraulic cylinder to the actuator pump, e.g. in the case of energy recuperation, as exemplified below. In the latter case, a movement of the piston, although caused by gravity, is understood here as being purely pump controlled, e.g. by the control of a braking torque of the pump.

It is understood that the rate of movement of the piston of the hydraulic cylinder is equal to the rate of change of the length of the hydraulic cylinder. It is further understood that by changing the length of the hydraulic cylinder, it is extended or shortened.

The fluid flow generated by the actuator pump may be controlled by controlling the displacement of the actuator pump or the speed of the actuator pump. Such fluid flow control may, in cases of pump speed control, be accomplished by the actuator pump being a rotational pump and by control of the rotational speed of the pump. In other embodiments, where the actuator pump has a variable displacement, the fluid flow control may be accomplished by control of the displacement setting of the pump.

The direct proportionality of the rate of movement of the piston of the hydraulic cylinder to the fluid flow generated by the actuator pump is preferably utilised so that the actuator pump speed and/or displacement is the single control variable of a control unit for the hydraulic cylinder. This in turn means, as opposed to LS-systems, no valve arrangement between the pump and the hydraulic cylinder is needed for the hydraulic cylinder control. Thus, no pressure drop in the system is required for the hydraulic cylinder control. In turn, this will allow the actuator pump to work, compared to a pump in an LS-system, with reduced power for a given task of the hydraulic cylinder. This will reduce energy consumption of the working machine implement manipulation.

The hydraulic accumulator may be arranged to be selectively connectable, e.g. with a valve, to the first port to be in free fluid communication with the first port. The hydraulic accumulator adapted to be in free fluid communication with the first port will provide, for example when the working machine is driven with the implement loaded, flexibility between the body structure and the implement, which is turn will smoothen the ride of the working machine, e.g. by absorbing shocks where the ground is rough. It is understood that the free fluid communication between the hydraulic accumulator and the first port allows fluid to flow freely in the connection between the hydraulic accumulator and the first port. Thereby, the hydraulic accumulator will provide an absorption of movements, e.g. oscillations, of the implement in relation to the body structure.

Some versions of implement suspension functions are known per se. Where the hydraulic cylinder is a lifting hydraulic cylinder adapted to raise and lower the implement, the arrangement of a hydraulic accumulator connectable to the hydraulic cylinder may be referred to as a boom suspension system (BSS). However, using the same pump for actuation and hydraulic accumulator charging will create a lack of accuracy in the hydraulic cylinder control. The reason is that the direct proportionality of the rate of movement of the piston of the hydraulic cylinder to the fluid flow generated by the actuator pump might be utilised for the hydraulic cylinder control, and if the actuator pump is not utilised solely for powering the hydraulic cylinder, it will not be possible to correctly determine the rate of movement of the piston of the hydraulic cylinder based on the fluid flow generated by the actuator pump.

Since the hydraulic accumulator is adapted to be pressurised by a further pump which is provided in addition to the actuator pump, the actuator pump can be dedicated only to power the hydraulic cylinder. This will in all operational situations make it possible to correctly determine the rate of movement of the piston of the hydraulic cylinder based on the fluid flow generated by the actuator pump.

The further pump may be any suitable pump in the working machine, which is provided in addition to the actuation pump, e.g. a pump for a hydraulic steering system of the working machine, for a hydraulic brake system of the working machine, and/or for a cooling fan of the working machine.

The first port of the hydraulic actuator may be provided on a piston side of the piston, i.e. the side without a piston rod, and the second port may be provided on a piston rod side of the piston. The first second ports may be adapted to be in fluid communication with respective ports of the actuator pump.

It is understood that by the hydraulic cylinder presenting the first and second ports adapted to be in fluid communication with the actuator pump, the hydraulic cylinder is adapted to move the implement in response to hydraulic fluid from the actuator pump being selectively directed to the first and second ports so as to move the hydraulic cylinder piston to change the length of the hydraulic cylinder. The possibility to select the fluid direction might be accomplished by a suitable valve arrangement, or by pump direction control, as exemplified below.

Preferably, the hydraulic cylinder and the actuator pump are arranged so that when the piston in the hydraulic cylinder is moved, fluid is moved from one of the first and second ports towards the other of the first and second ports via the actuator pump. Thus, the actuator pump may be provided as a bi-directional pump, which operates by merely moving fluid from one side of the hydraulic cylinder piston to another side of it. This provides a simple and robust solution.

Preferably, the hydraulic cylinder is a lifting hydraulic cylinder adapted to raise and lower the implement relative to the body structure of the working machine. Preferably, the actuator pump is adapted to be powered by an electric machine, in the form of an electric motor and generator, i.e. a device which can work as a motor as well as a generator. Preferably, the hydraulic system comprises an electric energy storage arrangement, and the electric machine is adapted to be electrically connected to the electric energy storage arrangement, the electric machine being adapted to be driven by the actuator pump when the implement is lowered relative to the body structure, and to thereby provide a charging current to the electric energy storage arrangement. Thereby, at least a part of the energy used for raising the implement may be recovered when lowering the implement. Such energy recuperation using the actuator pump will further increase the energy efficiency of the working machine.

Preferably, the hydraulic system comprises a boost pump adapted to provide pressurised fluid to one of the first and second ports, so that during extension of the hydraulic cylinder, pressurised fluid is provided from the actuator pump as well as the boost pump. This is particularly advantageous where the hydraulic cylinder and the actuator pump are arranged so that when the piston in the hydraulic cylinder is moved, fluid is moved from one of the first and second ports towards the other of the first and second ports via the actuator pump. For example, where the hydraulic cylinder is a lifting hydraulic cylinder adapted to raise and lower the implement, during extension of the lifting hydraulic cylinder so as to raise the implement, the piston rod therein will provide for less fluid leaving the lifting hydraulic cylinder than fluid needed to enter the lifting hydraulic cylinder. The boost pump will compensate for the effect of the difference in effective pressure area on opposite sides of the piston in the lifting hydraulic cylinder. It is understood that the boost pump is a suitable hydraulic pump.

It is understood that regardless whether or not the system comprises a boost pump, the hydraulic cylinder is flow controlled. More specifically, even if a boost pump is present as described above, the hydraulic cylinder is directly controlled by the actuator pump so that the rate of movement of the piston of the hydraulic cylinder is directly proportional to the fluid flow generated by the actuator pump. In the control of the hydraulic cylinder, the involvement of the boost pump may be taken into account by the volume, and hence the flow, compensated for by the boost pump being known. Thereby, the difference, depending on the direction of hydraulic cylinder movement, in the proportionality between the actuator pump fluid flow and the movement of the hydraulic cylinder piston, is known as well, and can be taken into account in the hydraulic cylinder control.

Where the hydraulic cylinder is a lifting hydraulic cylinder adapted to raise and lower the implement relative to the body structure of the working machine, the first and second ports are herein referred to as first and second lifting ports, and the actuator pump is referred to as a lifting actuator pump.

The hydraulic system may comprise a tilting actuator pump, and a tilting hydraulic cylinder with a cylinder and a piston which is adapted to move in the cylinder to thereby tilt the implement relative to the body structure, the tilting hydraulic cylinder presenting a first tilting port and a second tilting port adapted to be in fluid communication with the tilting actuator pump, the tilting hydraulic cylinder and the tilting actuator pump being arranged so that the rate of movement of the piston of the tilting hydraulic cylinder is purely pump controlled. Preferably, the rate of movement of the piston directly proportional to the fluid flow generated by the tilting actuator pump.

Thus, the direct proportionality of the rate of movement of the piston of the tilting hydraulic cylinder to the fluid flow generated by the tilting actuator pump, may be utilised so that the fluid flow generated by the tilting actuator pump is the single control variable of a control unit for the tilting hydraulic cylinder. This in turn means that, as opposed to an LS-system, no pressure drop in the system is required for the tilting hydraulic cylinder control, which allows the tilting actuator pump to work with an effective power consumption for a given task of the tilting hydraulic cylinder. This will further reduce energy consumption of the working machine implement manipulation. It is understood that the tilting actuator pump is a hydraulic pump.

The first and second tilting ports may be adapted to be in fluid communication with respective ports of the tilting actuator pump. The tilting hydraulic cylinder and the tilting actuator pump may be arranged so that when the piston in the tilting hydraulic cylinder is moved, fluid is moved from one of the first and second tilting ports towards the other of the first and second tilting ports via the tilting actuator pump. Thus, the tilting actuator pump may be provided as a bi-directional pump, providing a simple and robust solution.

Where a boost pump is provided as described above, the boost pump may be adapted to provide pressurised fluid to one of the first and second tilting ports, so that during extension of the tilting hydraulic cylinder, pressurised fluid is provided from the tilting actuator pump as well as the boost pump. Thus, the lifting and tilting hydraulic cylinders may share a single boost pump. This simplifies the hydraulic system, and reduces cost thereof.

It should be noted that in the case of a lifting hydraulic cylinder, it is normally arranged so that it is extended to raise the implement, and if a boost pump is provided for the lifting hydraulic cylinder, it will be arrange to deliver fluid to the cylinder during such raising of the implement. It is however conceivable to provide an opposite arrangement, i.e. where the lifting hydraulic cylinder is arranged, e.g. by some suitable linkage, so that it is shortened to raise the implement, and thereby the boost pump will be arrange to deliver fluid to the cylinder during lowering of the implement.

It should also be noted that by providing a hydraulic cylinder which presents during extension or shortening the same change of volume on both sides of the piston, no boost pump would be needed for such a hydraulic cylinder.

The hydraulic accumulator may be arranged to be selectively connectable to the first tilting port. Thereby, the hydraulic accumulator may be arranged to be in free fluid communication with the first tilting port, which may provide, when the working machine is driven with the implement loaded, a degree of flexibility of tilting movements of the implement, which is turn may smoothen the ride of the working machine.

Where the system comprises a lifting hydraulic cylinder as well as a tilting hydraulic cylinder, the hydraulic accumulator may be arranged to be selectively connectable to the first tilting port and/or the first lifting port. In any case, the hydraulic system comprises a further pump in addition to the actuator pump(s), and the hydraulic accumulator is arranged to be pressurised by the further pump.

According to another aspect of the invention, a method is provided for moving an implement of a working machine comprising a hydraulic cylinder with a cylinder and a piston which is adapted to move in the cylinder to change the length of the hydraulic cylinder to move the implement, the hydraulic cylinder presenting a first port and a second port adapted to be in fluid communication with an actuator pump, the working machine further comprising a hydraulic accumulator for suspension of the implement, which hydraulic accumulator is arranged to be in free fluid communication with the first port. The method comprises disconnecting the hydraulic accumulator from the first port, moving fluid to the second port via the actuator pump, whereby the rate of movement of the piston of the hydraulic cylinder is purely pump controlled, so as to shorten the hydraulic cylinder to lower the implement relative to a body structure of the working machine, pressurizing the hydraulic accumulator by a further pump which is provided in addition to the actuator pump, moving fluid to the first port by means of the actuator pump, whereby the rate of movement of the piston of the hydraulic cylinder is purely pump controlled, so as to extend the hydraulic cylinder to raise the implement relative to the body structure, and determining whether to provide a free fluid communication between the hydraulic accumulator and the first port.

The first and second ports may be adapted to be in fluid communication with respective ports of an actuator pump, and moving fluid to the second port may comprise moving fluid from the first port towards the second port. Moving fluid to the first port may comprise moving fluid from the second port towards the first port. The rate of movement of the piston of the hydraulic cylinder may be purely pump controlled such that said rate is directly proportional to the fluid flow through the actuator pump. Said rate may be directly proportional to the fluid flow generated by the actuator pump.

Similarly to the hydraulic system, the method provides for the actuator pump to be dedicated only to power the hydraulic cylinder, since the hydraulic accumulator is adapted to be pressurised by a further pump which is provided in addition to the actuator pump. This will in all operational situations make it possible to correctly determine the rate of movement of the piston of the hydraulic cylinder based on the fluid flow generated by the actuator pump.

Preferably, the method comprises determining the pressure at the hydraulic accumulator and/or at the first port. Thereby, the step of determining whether to provide a free fluid communication between the hydraulic accumulator and the first port, may be based on said determination of the pressure at the hydraulic accumulator and/or the first port. Also, the step of pressurizing the hydraulic accumulator by the further pump, may be preceded by a decision, e.g. by a control unit, whether to pressurise the hydraulic accumulator. Where the further pump is arranged to provide fluid to other consumers in the working machine, determining the pressure at the hydraulic accumulator and/or the first port will provide a possibility to prioritize and/or distribute the further pump work between the consumers, and thereby provide a basis for the decision whether to pressurise the hydraulic accumulator.

Preferably, the method comprises determining whether the pressure at the hydraulic accumulator is at least as high as the pressure at the first port, and the step of determining whether to provide a free fluid communication between the hydraulic accumulator and the first port, is based on said determination whether the pressure at the hydraulic accumulator is at least as high as the pressure at the first port. Thereby, movements of the implement due to a pressure difference between the hydraulic accumulator and the first port, at engagement of the hydraulic accumulator to the first port, can be avoided.

Preferably, the method comprises providing the free fluid communication between the hydraulic accumulator and the first port at least on the condition that the pressure at the hydraulic accumulator is at least as high as the pressure at the first port. Thereby, a sudden drop of the implement, at engagement of the hydraulic accumulator to the first port, can be avoided.

Preferably, providing the free fluid communication between the hydraulic accumulator and the first lifting port comprises allowing fluid to flow freely in the fluid communication between the hydraulic accumulator to the first lifting port. Thereby, the hydraulic accumulator will provide an absorption of movements, e.g. oscillations, of the implement in relation to the body structure.

Preferably, raising the implement comprises powering the actuator pump by an electric machine which is connected to an electric energy storage arrangement, and lowering the implement comprises driving the electric machine by the actuator pump, and thereby providing a charging current to the electric energy storage arrangement.

Preferably, raising the implement comprises providing pressurised fluid from the actuator pump as well as a boost pump.

According to another aspect of the invention, a computer program is provided comprising program code means for performing the steps of the method for moving an implement of a working machine as claimed or described herein, when said program is run on a computer.

According to another aspect of the invention, a computer readable medium is provided carrying a computer program comprising program code means for performing the steps of the method for moving an implement of a working machine as claimed or described herein, when said program is run on a computer.

According to another aspect of the invention, a control unit is provided for a hydraulic system for moving an implement of a working machine, the working machine comprising a hydraulic cylinder with a cylinder and a piston which is adapted to move in the cylinder to change the length of the hydraulic cylinder to move the implement, the hydraulic cylinder presenting a first port and a second port adapted to be in fluid communication with respective ports of an actuator pump, the working machine further comprising a hydraulic accumulator for suspension of the implement, which hydraulic accumulator is arranged to be in free fluid communication with the first port, the control unit being configured to to control a suspension control valve to disconnect the hydraulic accumulator from the first port, to control the actuator pump so as to move fluid to the second port via the actuator pump, whereby the rate of movement of the piston of the hydraulic cylinder is purely pump controlled, so as to shorten the hydraulic cylinder to lower the implement relative to a body structure of the working machine, to control a further pump which is provided in addition to the actuator pump so as to pressurise the hydraulic accumulator, to control the actuator pump so as to move fluid to the first port by means of the actuator pump, whereby the rate of movement of the piston of the hydraulic cylinder is purely pump controlled, so as to extend the hydraulic cylinder to raise the implement relative to the body structure, and to determine whether to provide a free fluid communication between the hydraulic accumulator and the first lifting actuator port.

Preferably the control unit is further adapted to determine whether the pressure at the hydraulic accumulator is at least as high as the pressure at the first lifting actuator port, and to determine whether to provide a free fluid communication between the hydraulic accumulator and the first port, based on said determination whether the pressure at the hydraulic accumulator is at least as high as the pressure at the first port.

Preferably the control unit is further adapted to control the suspension control valve, to provide the free fluid communication between the hydraulic accumulator and the first port, at least on the condition that the pressure at the hydraulic accumulator is at least as high as the pressure at the first port.

Preferably the control of the actuator pump to raise the implement comprises control of an electric machine to power the actuator pump, which electric machine is connected to an electric energy storage arrangement, and the control of the actuator pump to lower the implement comprises control of the electric machine to be driven by the actuator pump so as to provide a charging current to the electric energy storage arrangement.

Preferably, where the hydraulic system comprises a boost pump, the control unit is adapted to control the boost pump as well as the actuator pump to provide pressurised fluid from the actuator pump as well as the boost pump when raising the implement.

DESCRIPTION OF DRAWINGS

Below, embodiments of the invention will be described with reference to the drawings, in which.

DETAILED DESCRIPTION

Figure 1:
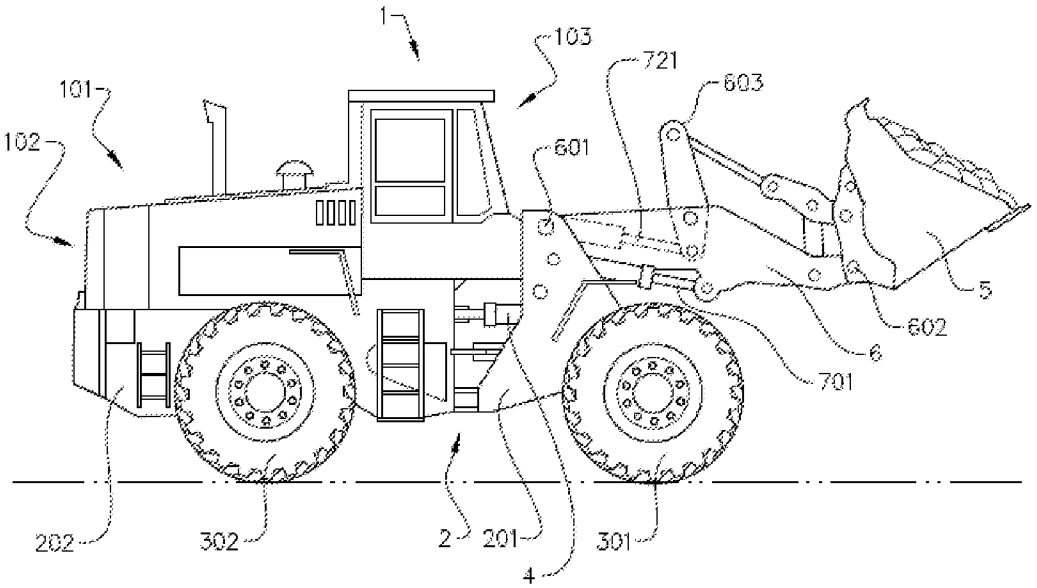
FIG. 1 is a side view of a wheel loader.

FIG. 1 is an illustration of a working machine 1 in the form of a wheel loader. The wheel loader is an example of a working machine where a hydraulic system according to the invention can be applied.

The wheel loader comprises a body structure 2 with a front body part 201 and a rear body part 202 presenting two front wheels 301 and two rear wheels 302, respectively. Two steering hydraulic cylinders 4 are arranged on opposite sides of the wheel loader 1 for turning the wheel loader by means of relative movement of the front body part 201 and the rear body part 202. In other words, the wheel loader 1 is articulated and frame steered by means of the steering hydraulic cylinders 4. There is a pivot joint connecting the front body part 201 and the rear body part 202 of the wheel loader 1 such that these parts are pivotally connected to each other for pivoting about a substantially vertical axis.

The rear body part 202 of the wheel loader 1 comprises an engine compartment 101 with an internal combustion engine and a radiator system 102. It should be noted that the invention is equally applicable to working machines with other types of power sources, such as electric hybrid drivetrains or fully electric drivetrains. The rear body part 202 further comprises a driver compartment 103.

The wheel loader 1 comprises an implement 5. The term "implement" is intended to comprise any kind of tool suitable for a wheel loader, such as a bucket, a fork or a gripping tool. The implement 5 illustrated in FIG. 1 is a bucket. The implement 5 is arranged on a load arm 6 for lifting and lowering the implement 5 relative to the body structure 2. More specifically, the elongated load arm 6 is at a first end rotatably connected to the front body part 201 at a first joint 601, and the implement 2 is mounted to the load arm 6 at a second joint 602 at a second end of the load arm 6.

A hydraulic system for moving the implement 5 comprises two lifting hydraulic cylinders 701, one of which is shown in FIG. 1. It should be noted that alternatively, the hydraulic system may comprise only one lifting hydraulic cylinder 701, or more than two lifting hydraulic cylinders 701. Each lifting hydraulic cylinder 701 extends between the front body part 201 and the load arm 6. The lifting hydraulic cylinders 701 are adapted to be extended so as to raise the implement 5 relative to the front body part 201, and to be shortened so as to lower the implement 5 relative to the front body part 201.

The implement 5 can also be tilted relative to the load arm 6. For this the implement 5 is pivotally mounted to the load arm 6 at the second joint 602. The hydraulic system for moving the implement 5 comprises a tilting hydraulic cylinder 721 in the form of a hydraulic cylinder. The tilting hydraulic cylinder 721 extends from the load arm 6 or the front body part 201 to a linkage mechanism 603, which is adapted to transfer movements from the tilting hydraulic cylinder 721 to the implement 5. The tilting hydraulic cylinder 721 and the linkage mechanism 603 can be adapted to tilt the implement 5 forward, i.e. away from the front body part 201, upon a shortening of the tilting hydraulic cylinder 721, and to tilt the implement 5 backwards, i.e. towards from the front body part 201, upon an extension of the tilting hydraulic cylinder 721.

Figure 2:
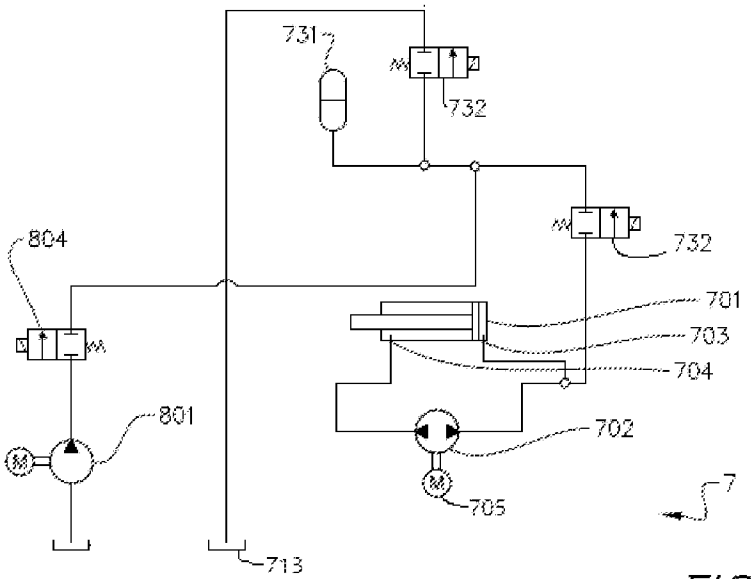
FIG. 2 is a diagram showing a conceptual layout of a hydraulic system for moving a bucket of the wheel loader in FIG. 1.

Reference is made also to FIG. 2, showing a conceptual layout of the hydraulic system 7. One of the lifting hydraulic cylinders 701 is shown. It should be noted however that the arrangement in FIG. 2 is equally applicable to tilting hydraulic cylinder 721. An electrically driven hydraulic lifting actuator pump 702 is provided to pump hydraulic fluid to the lifting hydraulic cylinders 701. The lifting actuator pump 702 is adapted to be powered by an electric machine 705. Each lifting hydraulic cylinder 701 presents a first lifting port 703 and a second lifting port 704. The first and second lifting ports 703, 704 are connected to a respective of two ports of the lifting actuator pump 702.

As also discussed below, to provide flexibility between the front body part 201 and the combination of the implement 5 and the load arm 6, in order to smoothen a ride of the wheel loader 1, the hydraulic system includes an implement suspension function. For the implement suspension function the hydraulic system comprises two hydraulic accumulators 731, one of which is shown in FIG. 2. The hydraulic accumulators 731 are adapted to be selectively in free fluid communication with the first lifting ports 703, via a suspension control valve 732. The suspension control valve 732 is also adapted to control a communication between the hydraulic accumulators 731 and a fluid return tank 713, as described closer below. Said two functions of the suspension control valve 732 is in FIG. 2 represented as two separate valves. The hydraulic accumulators 731 are adapted to be pressurised by a further pump 801 via a selection valve assembly 804, as described closer below.

Figure 3:
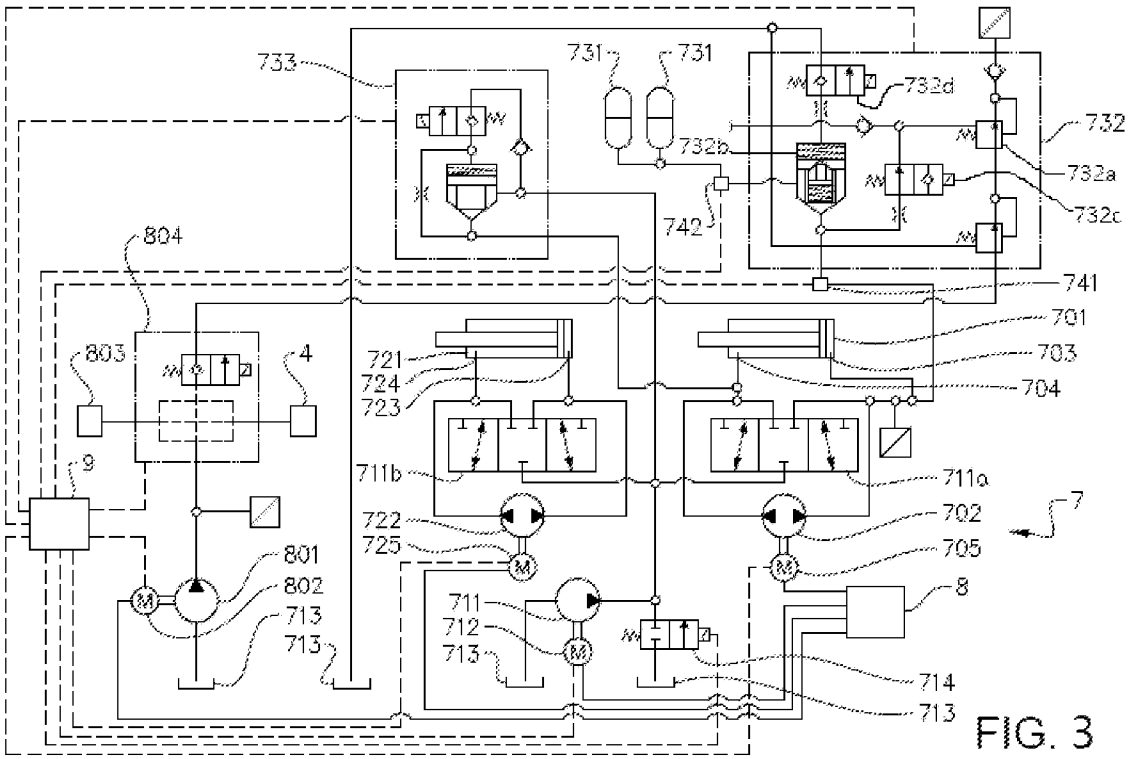
FIG. 3 is a diagram of the hydraulic system for moving a bucket of the wheel loader in FIG. 1, including further features of the particular embodiment.

Reference is also made to FIG. 3, showing additional features of the hydraulic system 7. The lifting actuator pump 702 is adapted to pump fluid selectively in two directions, by a selection of the rotational direction of the lifting actuator pump 702.

As mentioned, the lifting actuator pump 702 is adapted to be powered by the electric machine 705, herein also referred to as a first electric machine 705, which can be electrically connected to an electric energy storage arrangement in the form of a battery pack 8 of the wheel loader. The battery pack 8 is arrange to serve various electricity consuming devices on the wheel loader 1. An alternative form of the electric energy storage arrangement 8 could be a high-capacity electrochemical capacitor, also known as a super-capacitor. The electric motor may be provided in any suitable form, e.g. as a permanent magnet motor with a frequency converter.

The first electric machine 705, and thereby the lifting actuator pump 702, is adapted to be controlled by an electronic control unit 9 of the wheel loader 1. The control unit 9 can also be adapted to control other devices in the wheel loader 1, as exemplified below.

For extending the lifting hydraulic cylinders 701 so as to raise the implement 5, the control unit 9 controls the lifting actuator pump 702 to be driven in a first direction so as to pump fluid to the first lifting ports 703, which are on the piston side of the lifting hydraulic cylinders 701. Thereby, the lifting hydraulic cylinders 701 are extended, and fluid on the piston rod side, is guided to the lifting actuator pump 702 via the second lifting ports 704, which are provided on the piston rod side of the lifting hydraulic cylinders 701. Thus, during operation, the lifting actuator pump 702 moves fluid from one side of the hydraulic cylinder pistons towards the opposite side of the hydraulic cylinder pistons, i.e. from the piston rod side to the piston side.

Similarly, for shortening the lifting hydraulic cylinders 701 so as to lower the implement 5, the lifting actuator pump 702 is controlled so as to rotate in a second direction, opposite to the first direction. This will move fluid to the second lifting ports 704. Thereby, the lifting hydraulic cylinders 701 are shortened, and fluid is moved from one side of the hydraulic cylinder pistons via the first lifting ports 703 towards the second lifting ports 704 via the lifting actuator pump 702.

Regardless of whether the implement 5 is lifted or lowered, the lifting hydraulic cylinder 701 and the lifting actuator pump 702 are arranged so that the lifting hydraulic cylinder 701 is purely pump controlled. The lifting hydraulic cylinder is directly controlled by the lifting actuator pump 702 so that the rate of movement of the piston of the lifting hydraulic cylinder 701 is directly proportional to the fluid flow generated by the lifting actuator pump 702. In this embodiment, the rate of change of the length of the lifting hydraulic cylinder 701 is proportional to the speed of the lifting actuator pump 702.

When the implement 5 is raised, the first electric machine 705 works as a motor powered by the battery pack 8, and it drives the lifting actuator pump 702. When the implement 5 is lowered, the force of gravity acting on the implement 5 may provide a compression force on the lifting hydraulic cylinders 701, so as to force fluid via the first lifting ports 703 towards the second lifting ports 704 via the lifting actuator pump 702.

Thereby, the lifting actuator pump 702 will be driven by the transport of fluid, and in turn the lifting actuator pump 702 will drive the first electric machine 705. The latter may thereby work as a generator and provide a charging current to the battery pack 8. Thus, at least a part of the energy used for raising the implement 5 may be recovered when lowering the implement 5. During such an energy recovery, the control unit 9 may control the speed of the lifting actuator pump 702, and thereby the speed to the implement 5, by controlling the counter-torque of the first electric machine 705.

It should be noted that said energy recovery can be made if the implement 5 is loaded, as well as if the implement 5 is empty. The so called dead load of the implement 5, i.e. the weight of the implement when unloaded, as well as the weight of the load arm 6, contributes to the so called total dead load of the entire lift arrangement including the implement 5 and the load arm 6, and thereby to the load on the lifting hydraulic cylinder 701. Hence this total dead load will often provide for an energy recovery regardless whether the implement 5 is loaded or not.

The hydraulic system 7 further comprises a boost pump 711 to compensate for the effect of the difference in effective pressure area on opposite sides of the pistons in the lifting hydraulic cylinders 701. The control unit 9 is adapted to control the boost pump 711 by controlling an electric motor 712 which is adapted to be powered by the battery pack 8 and to drive the boost pump 711. The boost pump 711 is adapted to be supplied with fluid from the fluid return tank 713.

The hydraulic system 7 also comprises a lifting boost valve arrangement 711*a* providing a selection of a connection between the boost pump 711 and the first lifting ports 703 and a connection between the boost pump 711 and the second lifting ports 704. The lifting boost valve arrangement 711*a* may for example be controlled by the control unit 9, or by pilot ports connected to a respective of the connections between the lifting actuator pump 702 and the lifting ports 703, 704, as is known per se. The hydraulic system 7 further comprises a return tank valve 714 controllable by the control unit 9, and adapted to control a communication between the pressure side of the boost pump 711 and the fluid return tank 713.

During extension of the lifting hydraulic cylinders 701 so as to raise the implement 5, the piston rods therein will provide for less fluid leaving the lifting hydraulic cylinders 701 than fluid needed to enter the lifting hydraulic cylinders 701. Therefore, the control unit 9 is adapted to control the boost pump 711, the lifting boost valve arrangement 711*a* and the return tank valve 714 during extension of the lifting hydraulic cylinders 701 to provide pressurised fluid to the first lifting ports 703, so that pressurised fluid is provided from the lifting actuator pump 702 as well as the boost pump 711.

During shortening of the lifting hydraulic cylinders 701 so as to lower the implement 5, the piston rods therein will provide for more fluid leaving the lifting hydraulic cylinders 701 than fluid needed to enter the lifting hydraulic cylinders 701. Therefore, the control unit 9 is adapted to control the lifting boost valve arrangement 711*a* and the return tank valve 714 during shortening of the lifting hydraulic cylinders 701, so as for excess fluid to be returned from the lifting hydraulic cylinders 701 to the fluid return tank 713.

As can be seen in FIG. 3, an electrically driven hydraulic tilting actuator pump 722 is provided to pump hydraulic fluid to the tilting hydraulic cylinder 721. Similarly to the lifting actuator pump 702, the tilting actuator pump 722 is adapted to pump fluid selectively in two directions, and the tilting hydraulic cylinder 721 presents a first tilting port 723 and a second tilting port 724, which are connected to a respective of two ports of the tilting actuator pump 722.

The tilting actuator pump 722 is adapted to be powered by a second electric machine 725 which is connected to the battery pack 8 and adapted to be controlled by the control unit 9.

For extending the tilting hydraulic cylinder 721 so as to tilt the implement 5 backwards, the tilting actuator pump 722 is controlled so as to be driven in a first direction so as to pump fluid to the first tilting port 723 which is on the piston side of the tilting hydraulic cylinder 721. Thereby, fluid is moved from the piston rod side to the piston side of the tilting hydraulic cylinder 721. For shortening the tilting hydraulic cylinder 721 so as to tilt the implement 5 forward, the tilting actuator pump 722 is controlled so as to rotate opposite to the first direction, moving fluid via the first tilting port 723 on the piston side towards the second tilting port 724 on the piston rod side via the tilting actuator pump 722.

Regardless of whether the implement is tilted forward or backwards, the rate of change of the length of the tilting hydraulic cylinder 721 is proportional to the speed of the tilting actuator pump 722.

It should be noted that similarly to the operation of the lifting hydraulic cylinders 701, the operation of the tilting hydraulic cylinder 721 allows for energy recovery when the force of gravity acts in the direction of the tilting movement. Thereby, the tilting actuator pump 722 will be driven by the transport of fluid, and in turn the second electric machine 725 may thereby work as a generator and provide a charging current to the battery pack 8. During such an energy recovery, the control unit 9 may control the speed of the tilting actuator pump 722, by controlling the counter-torque of the second electric machine 725.

Similarly to the boost pump 711 function during the lifting hydraulic cylinder operation, the boost pump 711 is arranged to compensate for the effect of the difference in effective pressure area on opposite sides of the piston in the tilting hydraulic cylinder 721. The hydraulic system 7 comprises a tilting boost valve arrangement 711*b*, similar to the lifting boost valve arrangement 711*a*, providing a selection of a connection between the boost pump 711 and the first tilting port 723 and a connection between the boost pump 711 and the second tilting port 724.

The control unit 9 is adapted to control the boost pump 711, the tilting boost valve arrangement 711*b* and the return tank valve 714 during extension of the tilting hydraulic cylinder 721 to provide pressurised fluid to the first tilting port 723, so that pressurised fluid is provided from the tilting actuator pump 722 as well as the boost pump 711. Also, the control unit 9 is adapted to control the tilting boost valve arrangement 711*b* and the return tank valve 714 during shortening of the tilting hydraulic cylinder 721, so as for excess fluid to be returned from the tilting hydraulic cylinder 721 to the fluid return tank 713.

Where the implement 5 is as in this example a bucket, filling the bucket typically involves placing the bucket 5 on the ground, driving the wheel loader 1 forward so as to drive the bucket into the matter, e.g. gravel, to be handled, to fill the bucket 5, tilting the bucket 5 backwards, and raising the bucket 5. Regardless of the type of implement presented by the wheel loader 1, when the implement 5 is loaded and raised, the wheel loader may be driven some distance to a location where the implement is unloaded. As mentioned, to thereby provide flexibility between the front body part 201 and the combination of the implement 5 and the load arm 6, in order to smoothen the ride of the wheel loader 1, the hydraulic system includes an implement suspension function. Known versions of such functions are known as boom suspension systems.

As also mentioned, for the implement suspension function the hydraulic system comprises two hydraulic accumulators 731. These are provided in the form of hydraulic tanks for hydraulic fluid. As mentioned, the hydraulic accumulators 731 are adapted to be in free fluid communication with the first lifting ports 703 via the suspension control valve 732. The suspension control valve 732 is in turn is controllable by the control unit 9.

The hydraulic accumulators 731 are adapted to be pressurised by the further pump 801. The further pump 801 is adapted to the driven by an electric motor 802, which is controllable by the control unit 9. The further pump 801 is adapted to provide pressurised fluid to a brake fluid accumulator 803 of a brake system of the wheel loader 1, and to the steering hydraulic cylinders 4 (FIG. 1) for steering of the wheel loader 1.

The selection of the connection of the further pump 801 to the brake fluid accumulator 803, the steering hydraulic cylinders 4, and/or the hydraulic accumulators 731, is controllable by the selection valve assembly 804, which in turn is controllable by the control unit 9. The connection of the further pump 801 to the hydraulic accumulators 731 is further controllable by the suspension control valve 732.

A draining valve 733 is connected to the second ports 704 of the lifting hydraulic cylinders 701. The draining valve 733 is controllable by the control unit 9 and is adapted to drain, to the fluid return tank 713, excessive fluid from the actuation cylinders 701 when the implement suspension function is activated.

A first pressure sensor 741 is adapted to provide to the control unit 9 signals corresponding to the pressure in the first lifting ports 703. A second pressure sensor 742 is adapted to provide to the control unit 9 signals corresponding to the pressure in the hydraulic accumulators 731.

Figure 4:
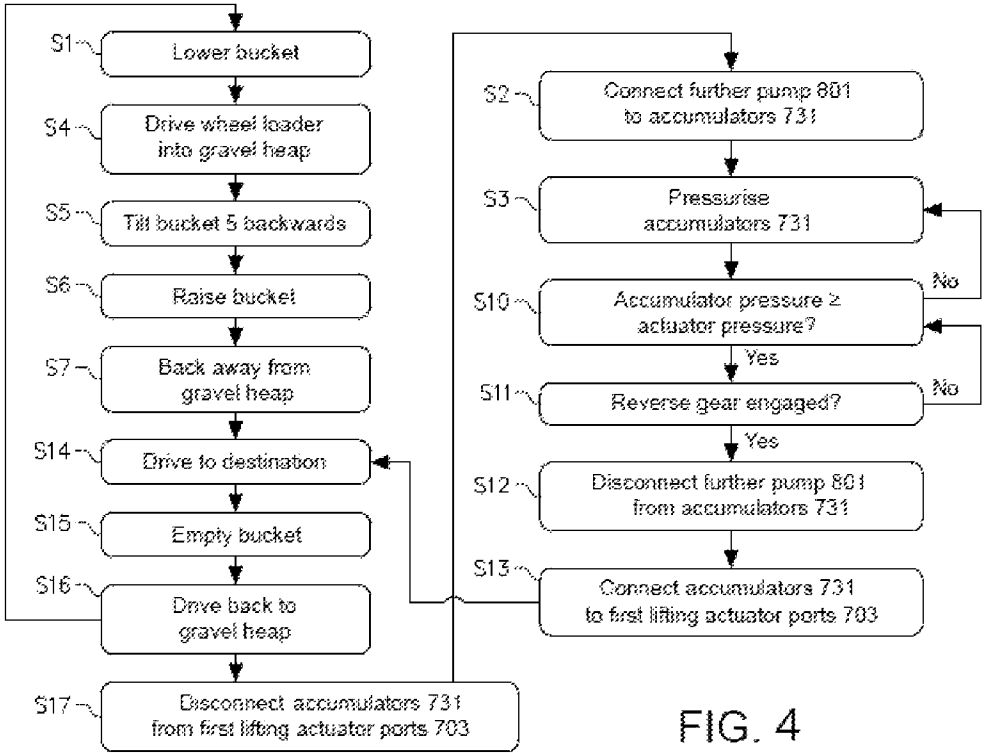
FIG. 4 is a block diagram of a method for controlling the wheel loader in FIG. 1.
Figure 5:
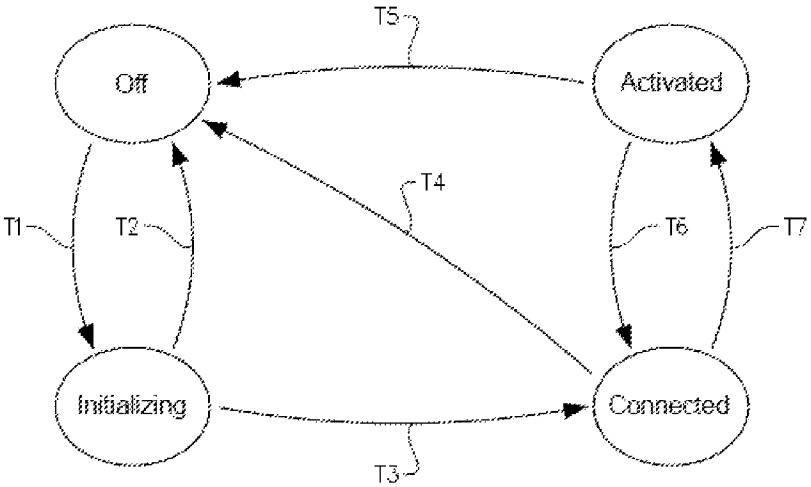
FIG. 5 is a block diagram depicting modes assumed by the hydraulic system during the method depicted in FIG. 4.

Reference is made also to FIG. 4 and FIG. 5 depicting steps in a method according to an embodiment of the invention. In the example presented below, the driver controls the wheel loader to fill the bucket 5 with gravel, and to drive to another location to drop the gravel there.

In the example herein, at the start the implement suspension function is turned off, meaning that the hydraulic accumulators 731 are disconnected from the lifting ports 703.

The bucket 5 is lowered S1 until it rests on the ground. For this, the driver controls the hydraulic system 7, via the control unit 9, so as to move fluid from the first lifting ports 703 towards the second lifting ports 704 via the lifting actuator pump 702, so as to shorten the lifting hydraulic cylinder 701. The rate of shortening of the lifting hydraulic cylinder being proportional to the speed of the actuator pump.

The driver also controls the wheel loader so as for a transmission thereof to enter a first gear. In this example, the wheel loader transmission is arranged to enter first gear by a driver transmission control action, e.g. to prepare for a bucket filling process. Differently, without such a driver transmission control action, the wheel loader transmission is arranged to automatically enter a second gear when starting from stand-still, e.g. when going into a transport phase.

Also, by a manual control action of the driver, the hydraulic system is made to enter an initializing mode (FIG. 5, T1). In this example, the control action consists of or comprises a manipulation of a momentary push-button switch. Alternatively, the hydraulic system can be arranged to enter the initializing mode automatically, e.g. at the entry of the wheel loader transmission into the first gear, or when exceeding a wheel loader velocity threshold value, such as zero.

In the initializing mode, the selection valve assembly 804 and the suspension control valve 732 connect S2 the further pump 801 to the hydraulic accumulators 731. Further the further pump 801 is controlled so as to pressurise S3 the hydraulic accumulators 731. The further pump 801 is thereby still connectable to the brake fluid accumulator 803 and the steering hydraulic cylinders 4. More specifically, in this example, the further pump 801 and the selection valve assembly 804 are arranged so as to prioritize providing pressure to the brake fluid accumulator 803 and the steering hydraulic cylinders 4. However, during a bucket filling phase, braking and steering control actions usually requires less pressure than in other phases, e.g. a transport phase.

While the hydraulic system 7 is in the initializing mode, the driver controls the wheel loader 1 so as to drive S4 into a heap or pile of gravel to fill the bucket. The driver then controls the hydraulic system 7, via the control unit 9, so as to tilt S5 the implement 5 backwards. For this, tilting actuator pump 722 moves fluid, via the second tilting port 724 and the tilting actuator pump 722, towards the first tilting actuator port 723, to extend the tilting hydraulic cylinder 721. Thereby, the rate of extending of the tilting hydraulic cylinder 721 is proportional to the speed of the tilting actuator pump 722.

The driver then controls the hydraulic system 7, via the control unit 9, so as to raise S6 the bucket 5. For this, fluid is moved from the second lifting ports 704 towards the first lifting ports 703 by means of the lifting actuator pump 702, so as to extend the lifting hydraulic cylinders 701. Thereby, the rate of extension of the lifting hydraulic cylinders 701 is proportional to the speed of the lifting actuator pump 702. The driver also controls the wheel loader transmission so as to enter a reverse gear, and controls the wheel loader so as to reverse to back away from the gravel heap S7.

A copy valve 732*a* of the suspension control valve 732 is arranged to ensure that during the pressurization of the hydraulic accumulators 731, the hydraulic accumulators 731 are not charged to a pressure which is higher than the pressure in the first lifting ports 703. For this the copy valve 732*a* is open only when the accumulator pressure is below the first lifting port pressure.

The suspension control valve 732 also comprises a logic valve 732*b*, which is adapted to balance the pressures in the hydraulic accumulators 731 and the first lifting ports 703 before they are connected. When the hydraulic system enters (FIG. 5, T3) a connection mode, in which the implement suspension function of the hydraulic system is on operation, the pressure in the hydraulic accumulators 731 might be higher than in the first lifting ports 703. This might be due to the pressure in the first lifting ports 703 having been reduced during the pressurization of the hydraulic accumulators 731. The logic valve 732*b* is arranged to drain such over-pressure in the hydraulic accumulators 731 to the fluid return tank 713, before connecting the hydraulic accumulators 731 and the first lifting ports 703.

During the pressurization of the hydraulic accumulators 731, the control unit 9 compares the signals from the first and second pressure sensors 741, 742. Based on this comparison, the control unit 9 determines S10 whether the pressure in the hydraulic accumulators 731 is at least as high as the fluid pressure at first lifting ports 703.

If the fluid pressure in the hydraulic accumulators 731 is at least as high as the fluid pressure at first lifting ports 703, it is determined S11 whether the wheel loader transmission has entered into the reverse gear. If the wheel loader transmission has entered into the reverse gear, the selection valve assembly 804 and the suspension control valve 732 disconnect S12 the further pump 801 from the hydraulic accumulators 731, and the suspension control valve 732 connects S13 the hydraulic accumulators 731 to the first lifting port 703. Thereby the control unit 9 closes a first control valve 732*c* of the suspension control valve 732, and opens a second control valve 732*d* of the suspension control valve 732, which will provide the pressure balancing of the logic valve 732*b* as described above. The hydraulic system thereby enters (FIG. 5, T3) the connection mode, and the implement suspension function of the hydraulic system is on operation.

It should be noted that in the example described here, the bucket movement control actions and the mode changes of the implement suspension function form to some extent parallel chains of events. The hydraulic accumulators 731 will be automatically connected to the first lifting port 703 for the hydraulic system to enter (FIG. 5, T3) a connection mode anytime the pressure and transmission requirements S10, S11 as described above is fulfilled.

The wheel loader is driven S14, with the hydraulic system in the connection mode, to the destination of the bucket load. When this destination is reached, the driver controls, via the control unit 9, the lifting and tilting hydraulic cylinders 701, 721 to empty S15 the bucket. The driver then drives back S16 to the gravel heap.

When back at the gravel heap, by a further manipulation of the momentary push-button switch, the hydraulic system is made to enter a mode herein referred to as an activated mode (FIG. 5, T7). In the activated mode, the suspension control valve 732 disconnects S17 the hydraulic accumulators 731 from the first lifting ports 703, and the selection valve assembly 804 and the suspension control valve 732 once again connect S2 the further pump 801 to the hydraulic accumulators 731, and the further pump 801 is controlled so as to pressurise S3 the hydraulic accumulators 731.

Referring to FIG. 5, it should be noted that in any of the initializing, connected and activated modes the driver may switch off the implement suspension function, whereby the hydraulic accumulators 731 are disconnected from the first lifting ports 703 and also from the further pump 801, (FIG. 5, T2, T4, T5).

Figure 6:
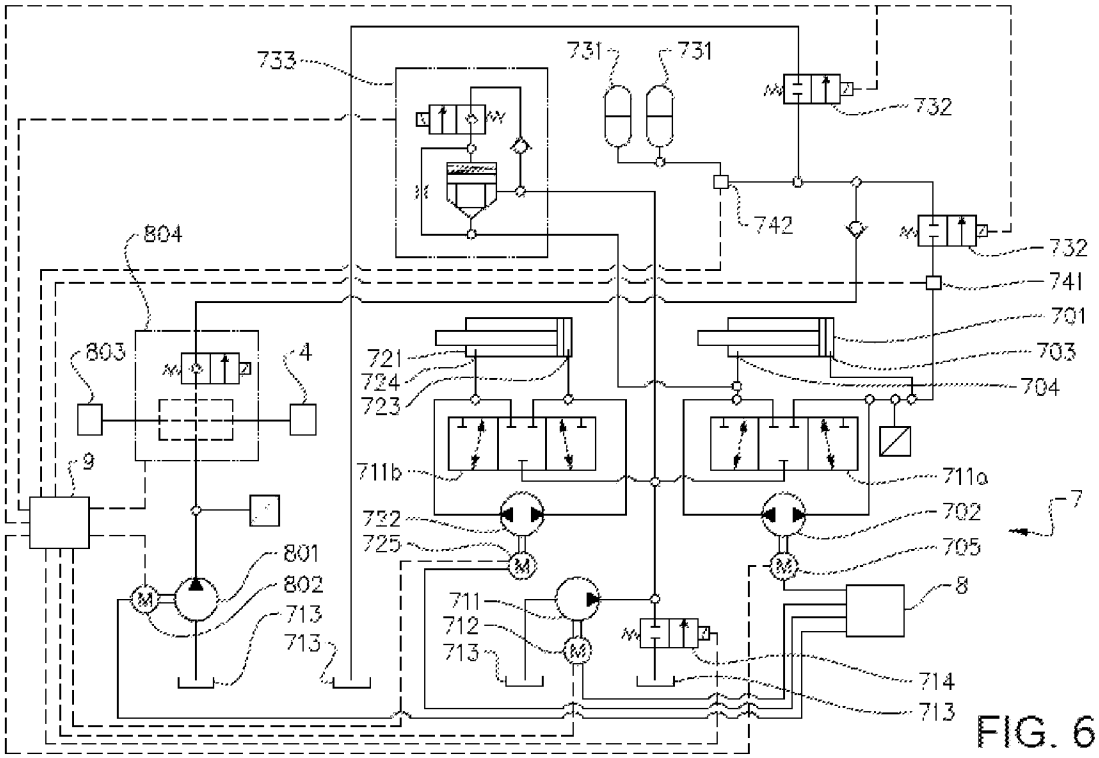
FIG. 6 is a diagram of a hydraulic system according to an alternative embodiment of the invention.

FIG. 6 shows a diagram of a hydraulic system 7 according to an alternative embodiment of the invention. In the hydraulic system 7 in FIG. 6, the suspension control valve 732 shown in FIG. 3 is replaced with two suspension control valves 732, adapted to control the communication between the hydraulic accumulators 731 and the first lifting ports 703, and between the hydraulic accumulators 731 and the fluid return tank 713, respectively. The communication between the further pump 801 and the hydraulic accumulators 731 is controllable by the selection valve assembly 804.

Further alternatives are possible within the scope of the claims. For example, instead of the control unit 9 comparing, during the pressurization of the hydraulic accumulators 731, the signals from the first and second pressure sensors 741, 742, and determining S10 based on this comparison whether to connect the hydraulic accumulators 731 and the first lifting ports 703, the suspension control valve 732 may be arranged to, in an analogue manner, "compare" said pressures, and "determine" whether to connect the hydraulic accumulators 731 and the first lifting ports 703, e.g. by a valve adapted to open at a certain threshold pressure difference.

The invention claimed is:

1. A hydraulic system for moving an implement of a working machine, the hydraulic system comprising:

a hydraulic cylinder with a cylinder and a piston which is adapted to move in the cylinder to thereby move the implement relative to a body structure of the working machine, an actuator pump arranged to provide hydraulic fluid to the hydraulic cylinder the hydraulic cylinder having a first port and a second port adapted to be in fluid communication with the actuator pump, the hydraulic cylinder and the actuator pump being arranged so that the hydraulic cylinder is directly controlled by the actuator pump so that the rate of movement of the piston of the hydraulic cylinder is purely pump controlled, a hydraulic accumulator for suspension of the implement, an electronically controlled suspension control valve arranged in fluid communication between the first port and the hydraulic accumulator, wherein the hydraulic accumulator is arranged to be selectively connectable to the first port, a further pump in addition to the actuator pump, the hydraulic accumulator being arranged to be pressurised by the further pump, and a control unit arranged to control the electronically suspension control valve to disconnect the hydraulic accumulator from the first port.

2. A hydraulic system according to claim 1, wherein the hydraulic cylinder and the actuator pump are arranged so that when the piston in the hydraulic cylinder is moved, fluid is moved from one of the first and second ports towards the other of the first and second ports via the actuator pump.

3. A hydraulic system according to claim 1, wherein the hydraulic cylinder is a lifting hydraulic cylinder adapted to raise and lower the implement relative to the body structure of the working machine.

4. A hydraulic system according to claim 1, wherein the actuator pump is adapted to be powered by an electric machine.

5. A hydraulic system according to claim 3, wherein the actuator pump is adapted to be powered by an electric machine, and wherein the hydraulic system comprises an electric energy storage arrangement, and wherein the electric machine is adapted to be electrically connected to the electric energy storage arrangement, the electric machine being adapted to be driven by the actuator pump when the implement is lowered relative to the body structure, and to thereby provide a charging current to the electric energy storage arrangement.

6. A hydraulic system according to claim 1, wherein the hydraulic system comprises a boost pump adapted to provide pressurised fluid to one of the first and second ports, so that during extension of the hydraulic cylinder, pressurised fluid is provided from the actuator pump as well as the boost pump.

7. A hydraulic system according to claim 1, wherein the hydraulic system comprises a tilting actuator pump, and a tilting hydraulic cylinder with a cylinder and a piston which is adapted to move in the cylinder to thereby tilt the implement relative to the body structure, the tilting hydraulic cylinder presenting a first tilting port and a second tilting port adapted to be in fluid communication with the tilting actuator pump, the tilting hydraulic cylinder and the tilting actuator pump being arranged so that the rate of movement of the piston of the tilting hydraulic cylinder is purely pump controlled.

8. A hydraulic system according to claim 6, wherein the hydraulic system comprises a tilting actuator pump, and a tilting hydraulic cylinder with a cylinder and a piston which is adapted to move in the cylinder to thereby tilt the implement relative to the body structure, the tilting hydraulic cylinder presenting a first tilting port and a second tilting port adapted to be in fluid communication with the tilting actuator pump, the tilting hydraulic cylinder and the tilting actuator pump being arranged so that the rate of movement of the piston of the tilting hydraulic cylinder is purely pump controlled, and wherein the boost pump is adapted to provide pressurised fluid to one of the first and second tilting ports, so that during extension of the tilting hydraulic cylinder, pressurised fluid is provided from the tilting actuator pump as well as the boost pump.

9. A hydraulic system according to claim 7, wherein the hydraulic accumulator is arranged to be selectively connectable to the first tilting port.

10. A hydraulic system according to claim 1, wherein the hydraulic cylinder is a tilting hydraulic cylinder with a cylinder, and a piston which is adapted to move in the cylinder to thereby tilt the implement relative to the body structure.

11. A working machine comprising a hydraulic system according to claim 1.

12. A method for moving an implement of a working machine comprising a hydraulic cylinder with a cylinder and a piston which is adapted to move in the cylinder to change the length of the hydraulic cylinder to move the implement, the hydraulic cylinder presenting a first port and a second port adapted to be in fluid communication with an actuator pump, the working machine further comprising a hydraulic accumulator for suspension of the implement, which hydraulic accumulator is arranged to be in free fluid communication with the first port, the method comprising disconnecting the hydraulic accumulator from the first port, moving fluid to the second port via the actuator pump, whereby the rate of movement of the piston of the hydraulic cylinder is purely pump controlled, so as to shorten the hydraulic cylinder to lower the implement relative to a body structure of the working machine, pressurizing the hydraulic accumulator by a further pump which is provided in addition to the actuator pump, moving fluid to the first port by means of the actuator pump, whereby the rate of movement of the piston of the hydraulic cylinder is purely pump controlled, so as to extend the hydraulic cylinder to raise the implement relative to the body structure, determining whether to provide a free fluid communication between the hydraulic accumulator and the first port, and determining the pressure at one of the hydraulic accumulator or the first port.

13. A method according to claim 12, comprising determining whether the pressure at the hydraulic accumulator is at least as high as the pressure at the first port, and the step of determining whether to provide a free fluid communication between the hydraulic accumulator and the first port, is based on the determination whether the pressure at the hydraulic accumulator is at least as high as the pressure at the first port.

14. A method according to claim 13, comprising providing the free fluid communication between the hydraulic accumulator and the first port at least on the condition that the pressure at the hydraulic accumulator is at least as high as the pressure at the first port.

15. A method according to claim 12, wherein providing the free fluid communication between the hydraulic accumulator and the first port comprises allowing fluid to flow freely in the fluid communication between the hydraulic accumulator to the first port.

16. A method according to claim 12, wherein raising the implement comprises powering the actuator pump by an electric machine which is connected to an electric energy storage arrangement, and lowering the implement comprises driving the electric machine by the actuator pump, and thereby providing a charging current to the electric energy storage arrangement.

17. A method according to claim 12, wherein raising the implement comprises providing pressurised fluid from the actuator pump as well as a boost pump.

18. A computer comprising a computer program or performing the steps of claim 12 when the program is run on the computer.

19. A non-transitory computer readable medium carrying a computer program for performing the steps of claim 12 when the program is run on a computer.

20. A control unit for a hydraulic system for moving an implement of a working machine comprising a hydraulic cylinder with a cylinder and a piston which is adapted to move in the cylinder to change the length of the hydraulic cylinder to move the implement, the hydraulic cylinder presenting a first port and a second port adapted to be in fluid communication with an actuator pump, the working machine further comprising a hydraulic accumulator for suspension of the implement, which hydraulic accumulator is arranged to be in free fluid communication with the first port, the control unit being configured to to control a suspension control valve to disconnect the hydraulic accumulator from the first port, to control the actuator pump so as to move fluid to the second port via the actuator pump, whereby the rate of movement of the piston of the hydraulic cylinder is purely pump controlled, so as to shorten the hydraulic cylinder to lower the implement relative to a body structure of the working machine, to control a further pump which is provided in addition to the actuator pump so as to pressurise the hydraulic accumulator, to control the actuator pump so as to move fluid to the first port by means of the actuator pump, whereby the rate of movement of the piston of the hydraulic cylinder is purely pump controlled, so as to extend the hydraulic cylinder to raise the implement relative to the body structure, and to determine whether to provide a free fluid communication between the hydraulic accumulator and the first port.

21. A control unit according to claim 20, further adapted to determine whether the pressure at the hydraulic accumulator is at least as high as the pressure at the first port, and to determine whether to provide a free fluid communication between the hydraulic accumulator and the first port, based on the determination whether the pressure at the hydraulic accumulator is at least as high as the pressure at the first port.

22. A control unit according to claim 21, further adapted to control the suspension control valve, to provide the free fluid communication between the hydraulic accumulator and the first port, at least on the condition that the pressure at the hydraulic accumulator is at least as high as the pressure at the first port.

23. A control unit according to claim 20, wherein the control of the actuator pump to raise the implement comprises control of an electric machine to power the actuator pump, which electric machine is connected to an electric energy storage arrangement, and the control of the actuator pump to lower the implement comprises control of the electric machine to be driven by the actuator pump so as to provide a charging current to the electric energy storage arrangement.

24. A control unit according to claim 20, where the hydraulic system comprises a boost pump, the control unit being adapted to control the boost pump as well as the actuator pump to provide pressurised fluid from the actuator pump as well as the boost pump when raising the implement.

* * * * *